US007121600B2

(12) United States Patent
Liberato et al.

(10) Patent No.: US 7,121,600 B2
(45) Date of Patent: Oct. 17, 2006

(54) PERSONNEL TRANSFER DEVICE FOR OFFSHORE USE

(75) Inventors: Frank Liberato, Portland, TX (US); Paul Liberato, Sugarland, TX (US)

(73) Assignee: Pugh Acquisition Company, Corpus Christi, TX (US)

( * ) Notice: Subject to any disclaimer, the term of this patent is extended or adjusted under 35 U.S.C. 154(b) by 101 days.

(21) Appl. No.: 10/428,486

(22) Filed: May 2, 2003

(65) Prior Publication Data

US 2004/0217611 A1 Nov. 4, 2004

(51) Int. Cl.
*B66C 1/12* (2006.01)

(52) U.S. Cl. ..... 294/77; 182/142

(58) Field of Classification Search ..... 294/77, 294/68.1, 68.3; 187/239; 182/10, 150; 441/80, 441/83, 87, 129; 267/140, 153; 244/137.1
See application file for complete search history.

(56) References Cited

U.S. PATENT DOCUMENTS 1,188,185 A * 6/1916 Krulish ..... 43/105
2,827,325 A * 3/1958 Pugh ..... 294/77
3,164,346 A * 1/1965 Bateson ..... 410/61
3,827,745 A * 8/1974 Pugh ..... 294/77
4,438,829 A * 3/1984 Waters ..... 182/142
4,883,301 A * 11/1989 Pugh ..... 294/77
5,074,382 A * 12/1991 Do ..... 187/239
5,092,644 A * 3/1992 Melerine ..... 294/77
5,549,342 A * 8/1996 Donaldson et al. ..... 294/77

* cited by examiner

*Primary Examiner*—Eileen D. Lillis
*Assistant Examiner*—Paul T. Chin
(74) *Attorney, Agent, or Firm*—Haynes and Boone, LLP

(57) ABSTRACT

A personnel transfer device is provided including a base, a top and a concentric lacings extending between the base and top. An expander post is coupled between the base and top for placing tension in the lacings extending between the base and the top. A hoist connection is provided for attachment of the personnel transfer device to a hoist so that the personnel transfer device may be lifted to transfer personnel therein from one place to another. The lacings are flexible when relaxed, and become taught when placed in tension. There are spaces between the taught lacings for easy ingress and egress and the taught lacings act to shield the occupants in the transfer device from inadvertent side impacted. The expander post is removable so the base and top can be collapsed together for compact storage.

7 Claims, 6 Drawing Sheets

PERSONNEL TRANSFER DEVICE FOR OFFSHORE USE

FIELD OF INVENTION

The present application relates to a personnel transfer device for offshore use to transfer personnel and cargo, between floating vessels and offshore drilling or production platforms.

BACKGROUND OF THE INVENTION

A personnel or cargo net as disclosed in U.S. Pat. No. 3,827,745 and further according to U.S. Pat. No. 4,883,301, has been a favorite device for transfer personnel and cargo, between floating vessels and offshore drilling or production platforms.

DETAILED DESCRIPTION OF THE ILLUSTRATIVE EMBODIMENTS

Figure 1:
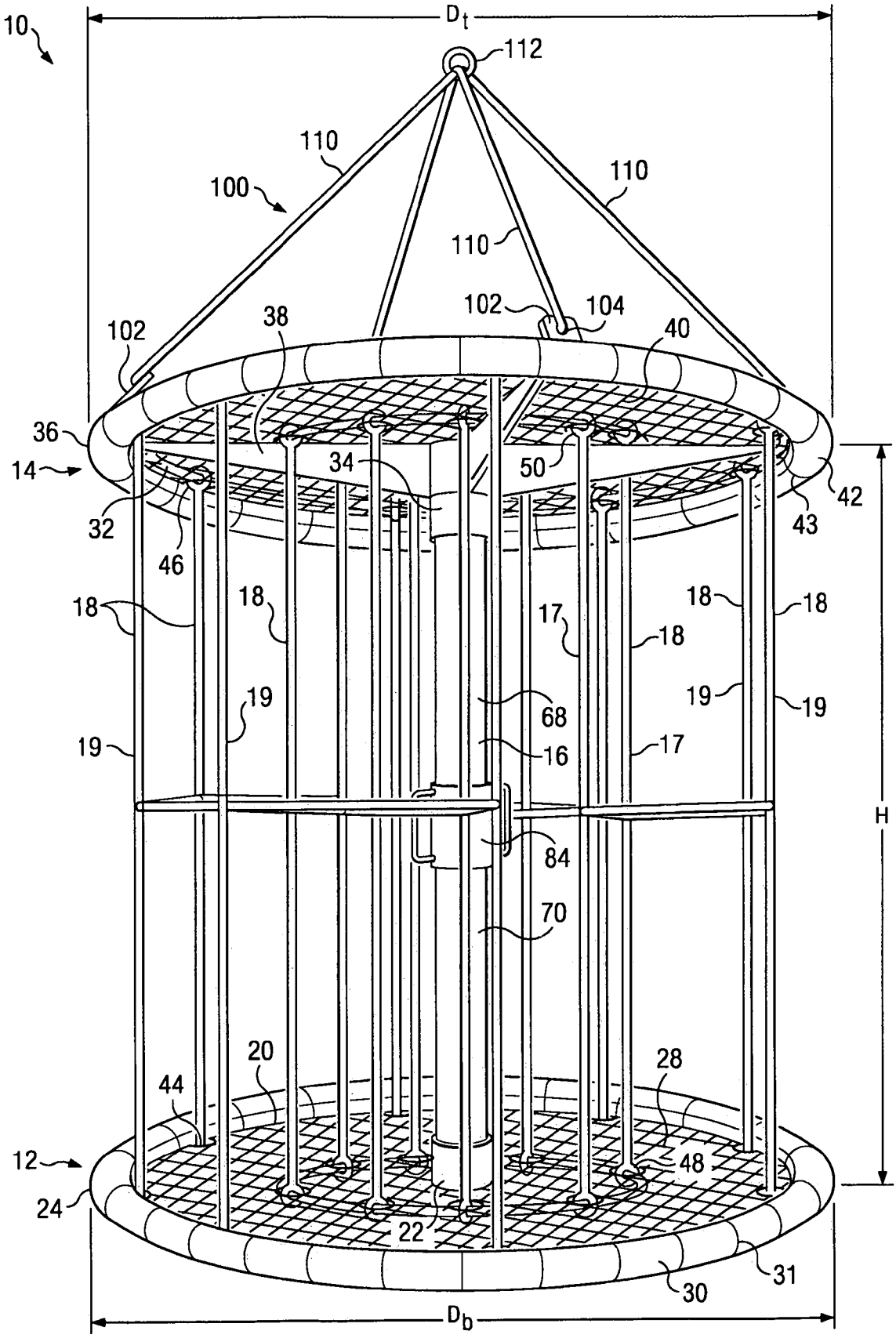
FIG. 1 is a perspective view of the personnel transfer device according to one embodiment of the invention.

Referring to FIG. 1 the personnel transfer device 10 is depicted. A base 12 is spaced apart from a top 14 by an expander post 16. A plurality of lacings 18 extend between the base 12 and the top 14. The lacings 18 are flexible when relaxed and become substantially rigid when tension is applied. The expander post 16 may be activated to expand the space between the base 12 and the top 14 and to thereby apply tension to the lacings 18.

The expander post 16 is sufficiently strong to impart a rigid connection between the base and the top and to impart significant tension to the lacings 18. For example, an aluminum tube having a nominal size of 4" schedule 80 has been found to work in one exemplary construction. The expander post 16 may also be disassembled and removed to allow the top 14 and the base 12 to be collapsed together for convenient storage without removing the lacings 18.

The base 12 may comprise a spreader ring 20 supporting a coupler 22. In the embodiment depicted the spreader ring 20 has a circular shape with periphery 24 having a diameter $D_b$ sufficiently large (for example 5' to 7' Dia.) to allow personnel to be carried thereon and the coupler 22 is supported centrally located as with supports 26. A platform 28 is also provided extending at least partially between the spreader ring 20 and the coupler 22 to permit personnel to stand on the platform 28. The platform 28 may also be supported by the supports 26. It has been found that a strong light weight metal tubing, such as aluminum tubing, may be used in the construction of the spreader ring 20 and also for the supports 26 and the expander post 16. For example, aluminum tubing having a nominal size of 1½" schedule 40 has been found to work in one exemplary construction. The platform 28 may be constructed of an light weight sheet material having a non-slip surface, such as diamond plate or expanded-metal grating. All of the metal material may be constructed of the same metal to reduce the adverse effect of cathode/anode induced corrosion. The periphery 24 of the spreader ring 20 maybe surrounded with a flotation padding 30, preferably having both significant buoyancy to help float the device and cushioning to reduce consequences from inadvertent side impact. The padding 30 may be fastened to the spreader ring and covered with a durable protective covering 31.

The top 14 may also comprise a top spreader ring 32 supporting a coupler 34. In the embodiment depicted the spreader ring 32 has a circular shape with periphery 36 having a diameter $D_t$ approximately the same as the base diameter $D_b$ to provide a convenient place for attachment of lacings 18 so that the lacings are substantially vertical between the base and top when the lacings are placed in tension. The coupler 34 is supported centrally located as with supports 38. A roof 40 is also provided extending at least partially between the top spreader ring 32 and the coupler 34 to allow personnel standing on the base 12 to have protection from above when standing on the platform 26. The roof 40 may also be supported by the radial supports 38. The periphery 36 may be surrounded with a flotation padding 42 attached to the spreader ring 32 and covered with a protective covering 43.

Figure 2:
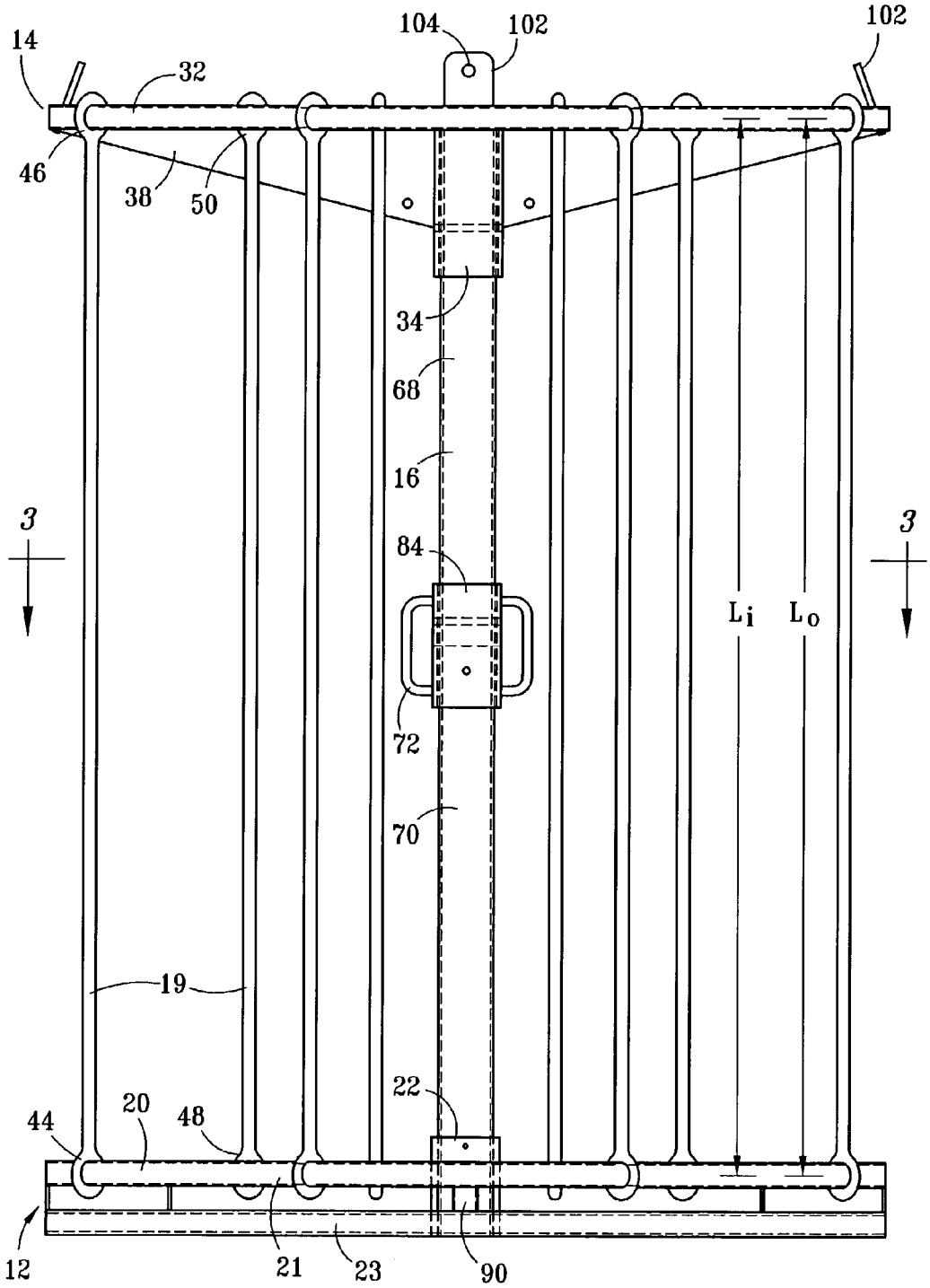
FIG. 2 is a side view of a personnel transfer device of according to the invention.

Referring to FIG. 2 along with FIG. 1, the plurality of lacings 18 are shown attached between the base 12 and the top 14. In an exemplary embodiment, the plurality of lacings 18 are positioned evenly spaced apart, with an outer set 19 of lacings 18, attached at or near the periphery 24 of the base 12 and at or near the periphery 36 of the top 14. The lacings 18 comprise flexible cords, lines, ropes, cable or like material having high strength and a low amount of stretch when placed in tension. The lacings 18 may be securely fastened to the base spreader ring 20 and the top spreader ring 32. At least an outer set 19 of the plurality of lacings 18 are provided. The lengths $L_o$ for all of the outer set 19 of lacings 18 are substantially equal, between the corresponding base attachment, at 44, and the top attachment, at 46, so that the base 12 and top 14 will be substantially parallel to each other when the plurality of lacings 18 are placed in tension.

In the exemplary embodiment shown, the attachments of the lacing, as at a plurality of base attachments 44 and top attachments 46, may be conveniently formed with loops around the spreader rings 20 and 32 respectively. The attachment loops at 44 and 46 may be securely formed at opposed ends of the lacings 18. High strength non-stretch lacings are desired. For example, it has been found suitable to construct such lacings from a high strength multi-stranded fiber, material, known as AMSTEEL® twelve strand, 9/16 inch, diameter, high molecular weight polyethylene (12 s, 9/16", HMWPE) available from Samson Rope Company. The manufacturer rates this material as having an average strength of 30,800 lbs. It has been found that such strong lacings attached at the periphery will become taught and therefore substantially "rigid" when the lacings are placed in tension and thereby form a barrier against side impact.

Figure 3:
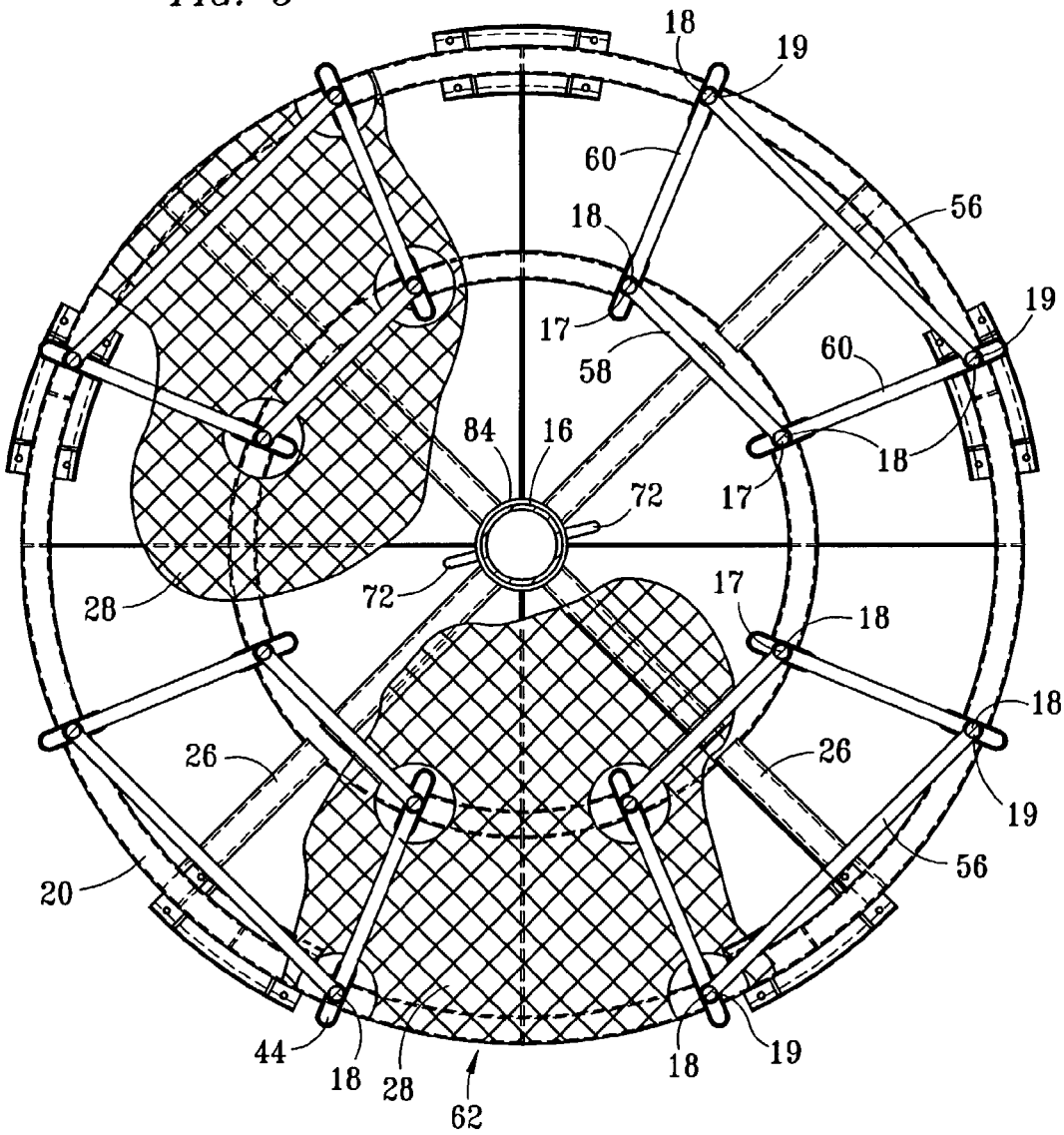
FIG. 3 is a section view, along section line 3—3 of FIG. 2, looking down through the tension lines and expander post onto the base of the personnel transfer device.
Figure 4:
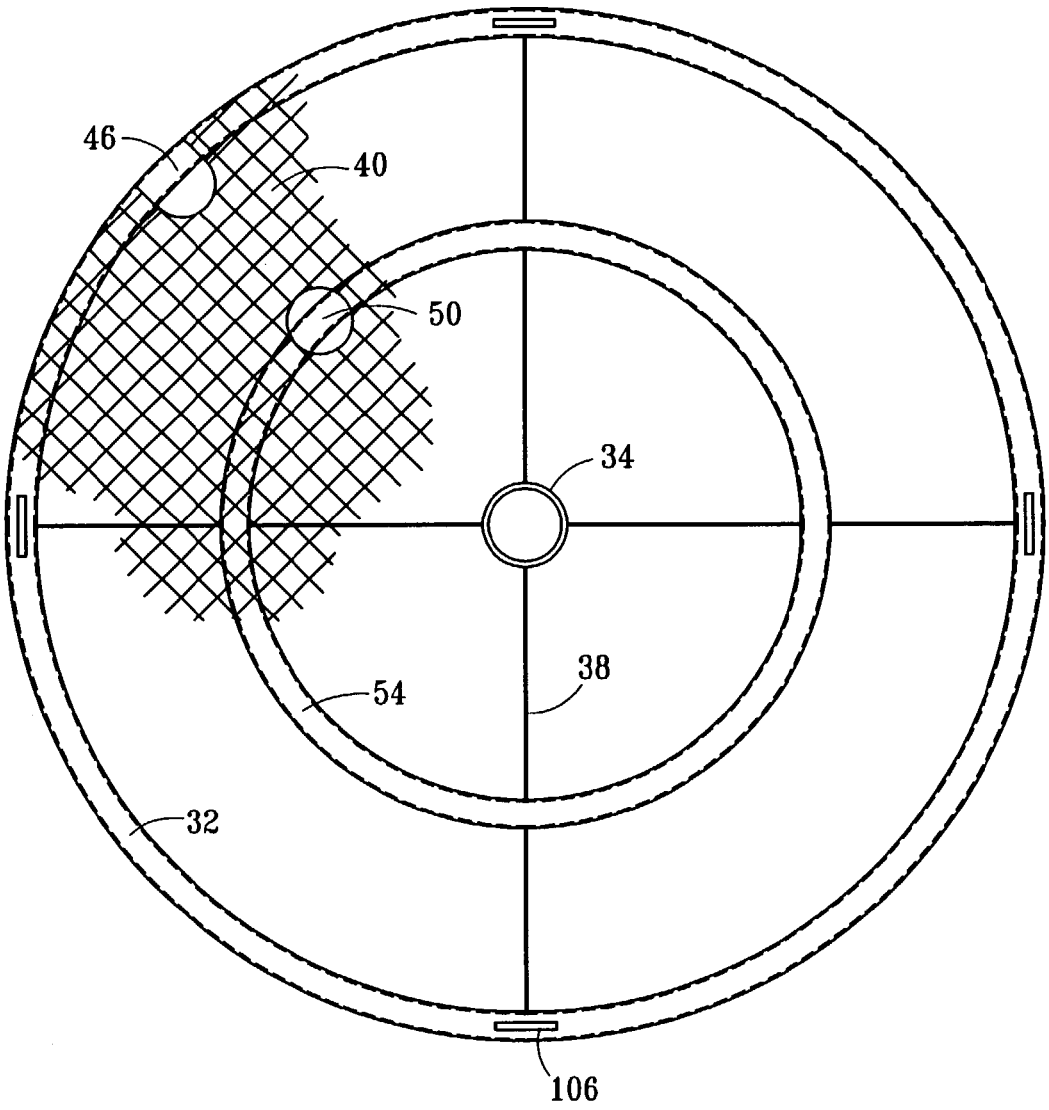
FIG. 4 is a top plan view of the top of the personnel transfer device of FIGS. 2 and 3.
Figure 5:
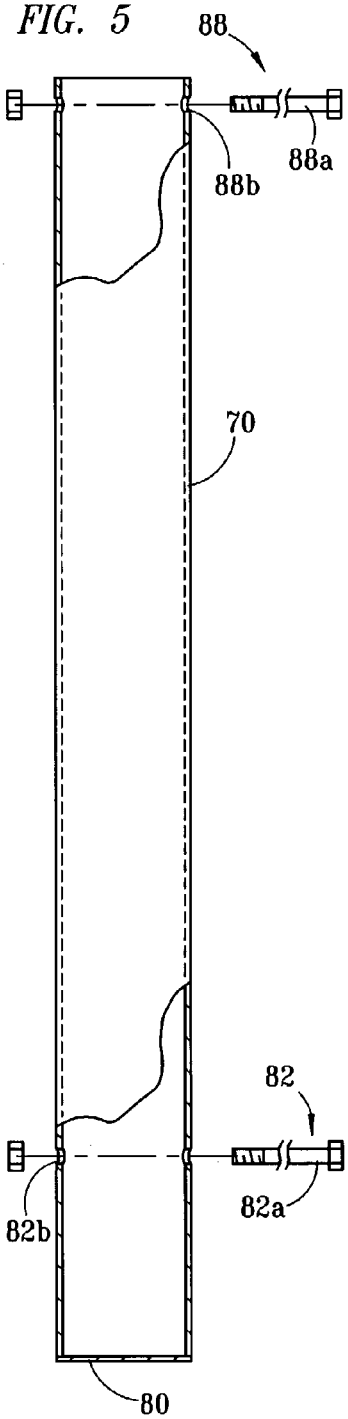
FIG. 5 is a side view with partial cutaway section of a portion of an expander post for coupling between the base and the top according to the invention.
Figure 7:
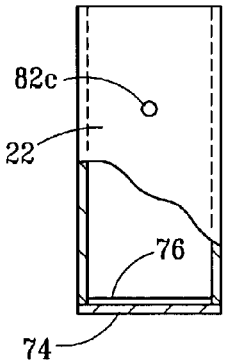
FIG. 7 is a side view with partial cutaway section of a coupler for coupling the expander post to the base.

Referring to FIGS. 2, 3 and 4, an the exemplary embodiment is shown, with an inner set 17 of the plurality of lacings 18 provided attached between the base 12 (FIGS. 2 and 3) and the top 14 (FIGS. 2 and 4). The inner set 17 of lacings 18 are attached at locations 48, at the base, and 50, at the top, spaced inside of the peripheries 24 and 36 of the base 12 and the top 14, respectively. For example, between the couplers 22 and 34 and the spreader rings 20 and 32, respectively. The lengths $L_i$ of the inner set 17 of lacings 18 may be equal to or slightly greater than the lengths $L_o$ of the outer set 19 of lacings 18. In a construction where all of the lacings 18 are of equal length, the inner set 17 of lacings will become taught, under tension created by the expander post expanding the distance between the base and the top, when the outer set 19 of lacings 18 become taught. Where the length $L_i$ is slightly less than $L_o$ the inner set 17 of lacings 18 may be place under some tension, when the outer set 19 of lacings 18 become taught and rigid. Thus, with the tension in the inner set 17 of lacings either equal to or less that the tension in the outer set 19 of lacings 18, the inner set 17 of lacings 18 are useful for providing hand gripping away from the periphery and vertical support for the personnel on board the transfer device. In the event of inadvertent impact from the outside, as by a bobbing boat deck or an inadvertent action of by a hoist operator, any onboard personnel will be shielded by the taught outer set 19 of lacings 18 from such side impact.

For ease of construction and for strength and durability of the personnel transportation device 10, the base 12 may further include a base inner ring 52 concentric with the outer spreader ring 20 and supported by the supports 28 between the outer spreader ring 20 and the base coupler 22. Similarly the top 14 may be constructed with a top inner ring 54 concentric with the outer top spreader ring 32 supported by the supports 38 between the top coupler 34 and the top spreader ring 32. In such an exemplary embodiment of the personnel transfer device, the outer set 19 of lacings 18 may be attached to the outer base and top spreader rings, 20 and 32, respectively. The inner set 17 of the lacings 18 may be attached to the inner base 52 and top inner top ring 54.

Referring to FIG. 3, an embodiment is depicted with even numbers of lacings 18 comprising the outer set 17 and corresponding even numbers of lacings comprising the inner set 19. It will be understood that additional stability may be provided to the lacings 18 by interconnecting together alternating pairs lacings 18 of the outer set 17 with outer cross-lacings 56. Corresponding alternating pairs of inner lacings may be interconnected together with inner cross lacings 58. Radial cross-lacings 60 may interconnect such alternating pairs of outer 17 and inner 19 lacings with radial gaps 62 or openings there between. Personnel may enter and exit through the gap 62 between the alternating pairs of interconnected lacings 18 and the cross lacings help provide stable support to such personnel while standing onboard.

Referring to FIGS. 5–9 construction of an exemplary expander post 16 is depicted in greater detail. The expander post 16 when assembled is coupled to the base at a base coupler 22 and couples to the top at a top coupler 34. The expander posts 16, when thus coupled, may be activated to expand and to increase the distance between the couplers 22 and 34 so that the distance between the base 12 and top 14 is increased. The lacings 18 are attached at a fixed length so that tension is paced in the lacings 18 by activating the expander post 16 into expansion.

Figure 6:
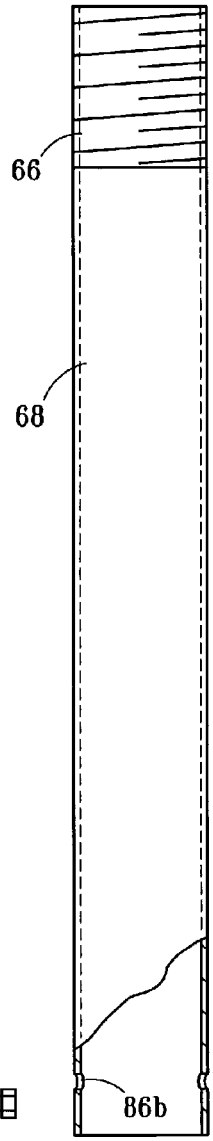
FIG. 6 is a side view with partial cutaway section of another portion of an expander post to be coupled between the base and the top according to the invention
Figure 8:
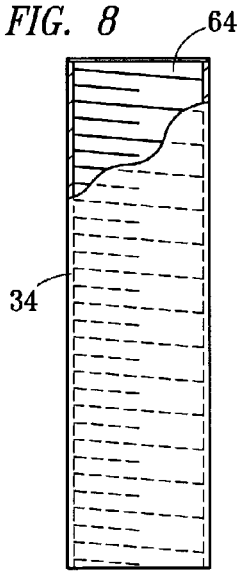
FIG. 8 is side view with partial cutaway section of a treaded coupler for coupling the expander post to the top.
Figure 9:
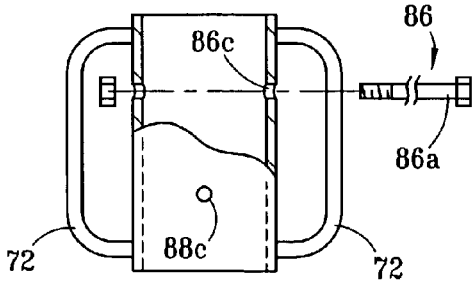
FIG. 9 is a side view with partial cutaway section of a coupler for coupling between the portions of the expander post in FIGS. 5 and 6.

In the exemplary embodiment depicted, at least one of the couplers 22 or 34 (top coupler 34 is depicted with threads in FIG. 7) is provided with threads 64. Matching threads 66 are also provided on a threaded portion of the expander post 16 (either on an upper portion 68 as depicted in FIG. 6 or on a lower portion 70). By rotating the treaded portion 68 of the expander post 16 relative to the treaded top coupler 34, the distance between the base 12 and the top 14 is either increased or decreased depending upon the direction of rotation. Handles 72 are provided attached to the threaded portion 68 of the expander post 16 to allow the expander post 16 to be activated to expand, by manual rotation of the threaded portion 68 of the expander post within the correspondingly threaded coupler 34. Internal threads are provided in the coupler 34 and external threads are provided on the portion 68 of expander post 16.

The base coupler 22 has an inside diameter for receiving the outside diameter of the lower portion 70 of the expander post 16. The expander post 16 fits closely within the base coupler 22 to provide coupling support while permitting relative rotation between the coupler 22 and the expander post 16. To further facilitate relative rotation, the inside of the coupler 22 is provided with a closed end 74 and with a friction reduced plate 76 or washer against which the end 74 of lower portion 70 may rotate. The reduced friction plate 76 might for example be constructed of a durable plastic or polymeric material. The lower portion 70 of the expander post 16 may also be provided with a closed end 80 to increase the engagement surface area with the coupler end 74. After rotation to the desired expanded length the lower portion 70 may be secured against rotation by a means for securing 82 such as a bolt 82*a* or pin through aligned holes 82*b* and 82*c* or other means for securing the expander post 16 and base coupler 22 against relative rotation or decoupling. While it is desirable for permitting moisture to drain from the threads in the top coupler 34, it will be understood that the construction might be reversed, with base coupler 22 being threaded and the lower portion 70 of the expander post 16 being threaded, without departing from certain aspects of the present invention. Other means for expanding the expander post 16, that are equivalent to the means and function describe, might also be employed without departing form certain aspects of the invention.

In the exemplary embodiment depicted, the expander post 16 is also constructed to permit it to be disassembled and thereby to allow the personnel transfer device to be collapsed for storage. An intermediate coupler 84 is provided for coupling the upper portion 68 and the lower portion 70 of the expander post 16. In this embodiment the intermediate coupler 84 is secured to the upper portion 68 of the expander post 16 with a means for securing 86, such as a bolt 86*a* or pin through aligned holes 86*b* and 86*c* or other means for securing the expander post 16 and coupler 84 against relative rotation or decoupling. Similarly the intermediate coupler 84 is secured to the lower portion 70 of the expander post 16 with a means for securing 88, such as a bolt 88*a* or pin through aligned holes 88*b* and 88*c* or other means for securing the expander post 16 and the intermediate coupler 84 against relative rotation or decoupling. The handles 72, for activating the expander post 16 to expand by manual rotation, are rigidly affixed as by welding or otherwise to the intermediate coupler 84.

In the embodiment shown the expander post 16 is further constructed with an upper portion 68 and a lower portion 70, inter-connected at an intermediate coupler 84. In this embodiment the top coupler 34 and the upper portion 68 of the expander post 16 are treaded. This orientation of the threads may facilitate drainage of moisture and thereby keep the threads in a better condition for smooth operation. The lower portion 70 is inserted into the base coupler 22 and secured thereto at securing means 82 as described above. The intermediate coupler 84 is rigidly attached to the upper threaded portion 68 of the expander post 16 and is provided with handles 72 so the intermediate coupler 84 may be manually rotated, and thereby rotating the upper threaded portion 68 of the expander post 16 within top coupler 34. The intermediate coupler 84 is also detachably secured to the lower portion 70 of expander post 16 as described above. It will be understood that to rotate the upper portion 68 of the expander post 16, either the intermediate coupler 84 should be un-secured, unbolted or unpinned, from the lower portion 70 or the lower portion 70 should be unsecured, unbolted or unpinned, from the base coupler 22, to thereby allow relative rotation of the threaded portion 68 of the expander post 16 and the treaded coupler 34 while still vertically coupled. After the threaded portion 68 is engaged in threaded coupler 34 and rotated sufficiently to expand the distance between the top 14 and base 12 sufficiently to provide the desired tension in the lacings 18, the unsecured portions of expander post 16 are then re-secured.

Figure 10:
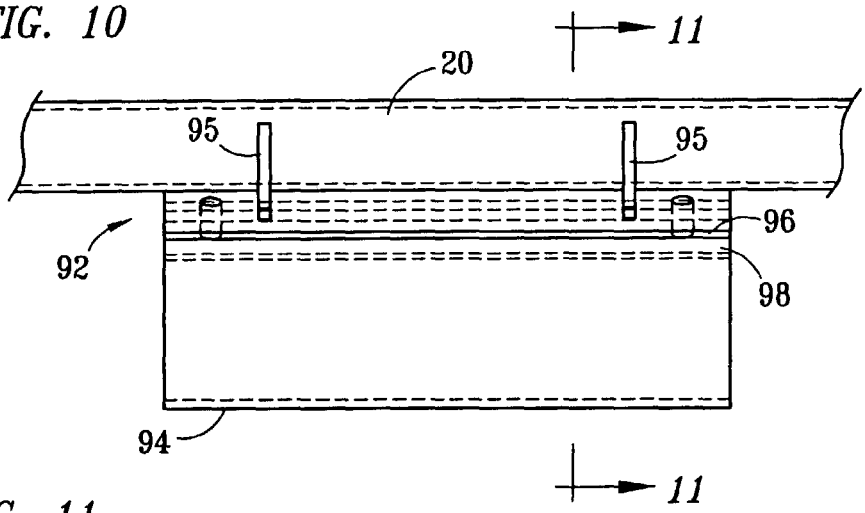
FIG. 10 is a partial side view with hidden lines showing construction of a floatation cushion connection.
Figure 11:
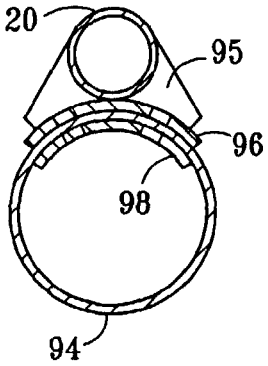
FIG. 11 is a section view taken along section line 11—11 of FIG. 10.
Figure 12:
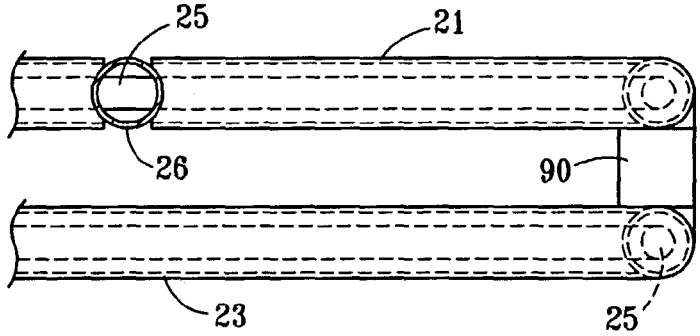
FIG. 12 is a partial side view of with hidden lines showing a construction of a base ring with two tubes and interposed reinforcement bar.

Referring to FIGS. 10, 11 and 12, details of construction of an exemplary embodiment of the base spreader ring 20 is shown. For increased strength, light weight construction of the spreader rings 20 and for the benefit of convenient and secure attachment of the flotation and cushioning material, spreader ring 20 may be constructed of two tubular metal rings 21 and 23. The two tubular rings 21 and 23 are secured parallel to each other and spaced a short distance from each other by a plurality of connecter bars 90 positioned around and between the two tubular rings 21 and 23. The tubular rings may be formed of a plurality of rolled tubular segments connected together as by welding or otherwise. The base inner ring 52 may also be constructed of tubular metal ring. The spreader ring 20, the base inner ring 52 and the base coupler 22 may be connected together with base supports 26, radially positioned from a centrally located base coupler 22.

The tubular spreader rings, spacer bars, inner rings, supports, coupler and platform may all be constructed of aluminum to provide a light weight structure that can be welded together. For added strength, and particularly for strength at interconnecting segments, the tubular rings 21 and 23 may further be provided with reinforcement bars 25, rolled inside to the tubular rings 21 and 23. The platform 28, as indicated may be a plate, grating, or screen material to facilitate non-slip standing by personnel being transferred thereon.

The top spreader ring 32 and top inner ring 54 may also be constructed of rolled tubular metal connected together and to a centrally located top coupler 34 with radial supports 38. To provide added support a treaded top coupler 34, the radial supports 38 may be in the form of triangularly shaped plates. All the top spreader ring 32, top inner ring 54, supports 38, and top coupler 34, may be constructed of aluminum for strong, light weight and conveniently welded construction.

In an exemplary embodiment, the floatation padding 30 may be conveniently attached to an expander ring with an attachment mechanism 92 as depicted in FIGS. 10 and 11. For example, a tube section 94 is attached by a welded connector 95 to a spreader ring 20. The welded connector 95 and tube 94 may be reinforced with interposed reinforcing sections 96 and 98. A plurality of similarly constructed attachment mechanisms may be spaced around the spreader ring 20. A flexible solid cylinder of flotation material (not shown in FIGS. 10 and 11 for clarity) is inserted and held within the tube sections 94.

Figure 13:
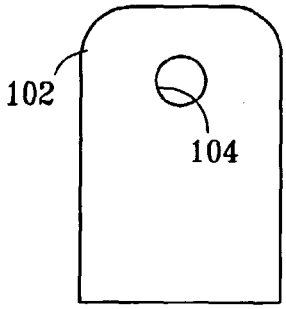
FIG. 13 is a front plan view of a lift connection plate.
Figure 14:
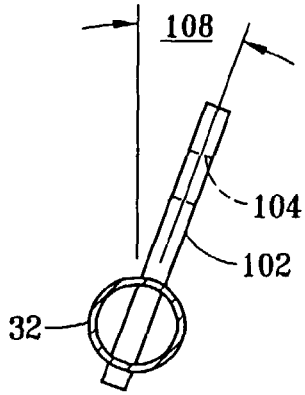
FIG. 14 is a side vie of a the lift connection plate of FIG. 13 shown attached at an angle to a top spreader ring.

Referring to FIGS. 1, 12 and 13 the construction and attachment of a lift connector 100 may be seen. The lift connector 100 may be in the form of a plurality of plates 102, each plate 102 having a hole 104 formed therein and each is securely fastened into slots 106 formed in the top spreader ring 32 at an angle 108 so that a plurality of lines 110 may be attached and then connected a together at a lifting link 112. A hoist, crane or other controllable lifting mechanism (not shown) may be attached at the lifting link to transport the personnel transfer device from one location to another, such as between a boat deck and an offshore platform

VARIATIONS AND EQUIVALENTS

It is understood that variations may be made in the foregoing without departing from the scope of the invention. For example, terms with directional connotations such as base, top, upper, lower, outer, and inner are used in context for purposes of relative positions and the device need not be limited to absolute directions in order to fall within the scope of the invention described and claimed. While various features and embodiments are described in certain combinations and sub-combinations selected features from one embodiment may be combined with features of other embodiments without departing from certain aspects of the invention.

The lacings 18 may alternatively be constructed of successive layers of polyurethane, fiberglass resin, and polypropylene rope, as described in U.S. Pat. No. 4,789,045, incorporated herein by reference. Other means for attachment and other types of lacings that are flexible when relaxed and strong and substantially "rigid" in tension may be employed without departing from certain aspects of the invention.

The expander post may be another means for expanding the distance between the base and the top to tension the lacings 18. The activation into expansion was shown as a manual treaded device but might be a cam actuated device, a hydraulically actuated or electrically actuate expansion device that can be secured into place when the expansion is completed, without departing from certain aspects of the invention.

The securing means are shown as bolts but may be other removable fastener devices without varying from certain aspects of the invention.

The construction is shown as aluminum but could be other construction with sufficient strength and durability.

Although only a few exemplary embodiments of this invention have been described in detail above, those skilled in the art will readily appreciate that many other modifications are possible in the exemplary embodiments without materially departing from the novel teachings and advantages of this invention. Accordingly, all such modifications are intended to be included within the scope of this invention as claimed in the claims that follow and to which applicants may be entitled.

What is claimed is:

1. A personnel transfer device comprising:

a base;

a top;

a plurality of concentric sets of lacings extending between the base and top;

an expander post coupled between the base and top for placing tension in the plurality of lacings extending between the base and the top;

a hoist connection for attachment of the personnel transfer device to a hoist so that the personnel transfer device may be lifted to transfer personnel thereon from one place to another;

the lacings including a set of inner lacings and a set of outer lacings the set of outer lacings comprising at least three flexible lacings of substantially equal length attached to the base and to the top at corresponding spaced apart locations and being attached toward the periphery of the base and the periphery of the top so that tension in the outer lacings causes the top to be substantially parallel to the base; and the set of inner lacings comprising flexible lacings attached to the base and the top at corresponding locations being spaced toward the center of the base and the top, and each inner lacing having a length between the base attachment location and the top attachment location that is at least as long as the substantially equal length of the at least three outer lacings so that the base and the top remain parallel when any of the set of inner lacings is also placed in tension.

2. A personnel transfer device as in claim 1, further comprising:

a first coupling attached to the base for coupling of the expander post to the base;

a second coupling attached to the top for coupling of the expander post to the top;

threads formed between at least one of the couplings and the expander post so that rotation of a portion of the expander post in one direction increases the distance between the base and the top to place tension on the lacings extending between the base and top.

3. A personnel transfer device as in claim 2, wherein the base further comprises:

at least one base spreader ring; and a support structure extending at least partially between the base spreader ring and the first coupling to support the first coupling from the base spreader ring; and wherein the top further comprises:

at least one top spreader ring; and a support structure extending at least partially between the top spreader ring and the second coupling to support the second coupling from the top spreader ring.

4. A personnel transfer device as in claim 1, wherein the set of inner lacings comprises at least three flexible lacings.

5. A personnel transfer device as in claim 1, wherein the set of outer lacings comprises an even number of at least four flexible lacings.

6. A personnel transfer device as in claim 5, wherein the plurality of lacings further comprise cross-lacings between alternate pairs of the outer lacings so that personnel may enter the personnel transfer device through pairs of lacings without cross-lacings.

7. A personnel transfer device as in claim 6 wherein the set of inner lacings further comprises an even number of at least four flexible lacings equal to the number of outer lacings and attached to the base and to the top at corresponding spaced apart locations toward the center and adjacent to the outer lacings and with cross-lacings between alternate pairs of inner lacings and radial-lacings between the inner and outer lacings so that personnel may enter alternate through pairs of outer lacings without cross-lacings and between the radial-lacings.

* * * * *

UNITED STATES PATENT AND TRADEMARK OFFICE

CERTIFICATE OF CORRECTION

PATENT NO. : 7,121,600 B2
APPLICATION NO. : 10/428486
DATED : October 17, 2006
INVENTOR(S) : Frank Liberato et al.

It is certified that error appears in the above-identified patent and that said Letters Patent is hereby corrected as shown below:

Title Page, Item (57) Abstract; first sentence after the word “and” delete “a”.

Claim 1, Column 7, Lines 17-18; after the word lacings insert --;--.

Signed and Sealed this

Thirtieth Day of June, 2009

JOHN DOLL
*Acting Director of the United States Patent and Trademark Office*